US006592327B2

(12) United States Patent
Chen et al.

(10) Patent No.: US 6,592,327 B2
(45) Date of Patent: Jul. 15, 2003

(54) HOT SWAP FAN MODULE

(75) Inventors: Ku-Feng Chen, Taipei (TW); Yu-Lin Chen, Taipei (TW)

(73) Assignee: Quanta Computer, Inc., Taoyuan Hsien (TW)

( * ) Notice: Subject to any disclaimer, the term of this patent is extended or adjusted under 35 U.S.C. 154(b) by 0 days.

(21) Appl. No.: 10/039,366

(22) Filed: Jan. 3, 2002

(65) Prior Publication Data

US 2003/0035724 A1 Feb. 20, 2003

(30) Foreign Application Priority Data

Aug. 17, 2001 (TW) ..... 90214142 U

(51) Int. Cl.[7] ..... F04D 29/64
(52) U.S. Cl. ..... 415/213.1; 415/220
(58) Field of Search ..... 415/213.1, 220; 416/244 R; 361/695, 697; 417/423.14, 423.15

(56) References Cited

U.S. PATENT DOCUMENTS 5,788,566 A * 8/1998 McAnally et al. ..... 454/184
6,373,698 B1 * 4/2002 Christensen ..... 361/695
6,375,440 B2 * 4/2002 Kosugi ..... 417/423.14
6,493,225 B2 * 12/2002 Chuang et al. ..... 361/695

* cited by examiner

*Primary Examiner*—Ninh H. Nguyen
(74) *Attorney, Agent, or Firm*—Perkins Coie LLP

(57) ABSTRACT

A hot swap fan module for a server is described. The server has a fixed frame for installing the hot swap fan module. The module has at least one fan electrically connected with a power plug and having two sides. Each side of the fan has four holes. Each of two identical plastic moldings has four protuberances through the four holes for imbedding each of the plastic moldings on each side of the fan.

18 Claims, 3 Drawing Sheets

HOT SWAP FAN MODULE

CROSS REFERENCE TO RELATED APPLICATIONS

The present application claims priority from Taiwan Patent Application No. 90214142, filed Aug. 17, 2001, incorporated herein by reference.

FIELD OF THE INVENTION

The present invention relates to computer equipment. More particularly, it relates to a hot swap fan module.

BACKGROUND OF THE INVENTION

In a design of hot swap fans for a computer (e.g., server), software is necessary for supporting the fans to have hot-swap modes. Moreover, the failure-pilot lamp, conventionally equipped for each fan, is also supported by necessary hardware. In addition to the software and hardware, proper material is necessary as a medium between the fans. Furthermore, to accommodate the hot-swap designation, the style of the power plug for the fan should be changed to, for example, metal fragments serving as the contact medium between the power and the fan. Such metal fragments occupy a lot of space, and space-saving consideration is therefore important.

On the other hand, four standard fastening holes, conventionally opened on the two sides of a fan, function by being penetrated with four screws accompanied by some iron fragments. It is noted that those screws and iron fragments also waste space. Moreover, it is troublesome to install the screws using tools, and fan maintenance is therefore not convenient.

SUMMARY OF THE INVENTION

It is an object of this invention to provide a hot swap fan module that can be installed or removed without tools.

In accordance with the aforementioned object of this invention, the invention provides a hot swap fan module for a server, wherein the server has a fixed frame hot swap fan module installation. At least one fan is electrically connected with a power plug and has two sides, wherein each side of the fan has four holes. Each of two identical plastic moldings each has four protuberances through the four holes for imbedding each of the plastic moldings into each side of the fan.

According to a preferred embodiment of the present invention, each of the plastic moldings has a fastener for fastening the power plug beneath one of the plastic moldings. Moreover, each of the plastic moldings has a holder for an operator to install the hot swap fan module into the fixed frame or to pull the hot swap fan module out of the fixed frame.

In another aspect, the present invention provides a plastic molding assembly for a fan of a server, wherein the server has a fixed frame for the fan having two sides, the plastic molding assembly comprises a plurality of plastic bodies, a plurality of protuberances and a holder on each of the plastic bodies. The protuberances are located beside each of the plastic bodies for imbedding the plastic bodies into the two sides of the fan. The holder is for an operator to install the plastic molding assembly and the fan into the fixed frame of the server.

According to a preferred embodiment of the present invention, each of the sides of the fan has a plurality of holes corresponding to the protuberances. In this case, the plastic bodies are embedded into the two sides of the fan through the holes.

In still another aspect, the present invention provides a cooling kit for a server. At least one fan is electrically connected with a power plug and has two sides, wherein each of the two sides has a plurality of holes. Two plastic moldings each have four fastening devices through the four holes for imbedding each of the plastic moldings on each side of the fan. The cooling kit may comprise at least one fixed frame for the fan to be installed therein or to be pulled out from.

The fan embedded with plastic moldings is only slightly thicker than the original fan by two plastic plates (the exposed portions of the plastic moldings). On the other hand, there is no need to change the style of the power plug of the fan to accommodate the hot-swap designation.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
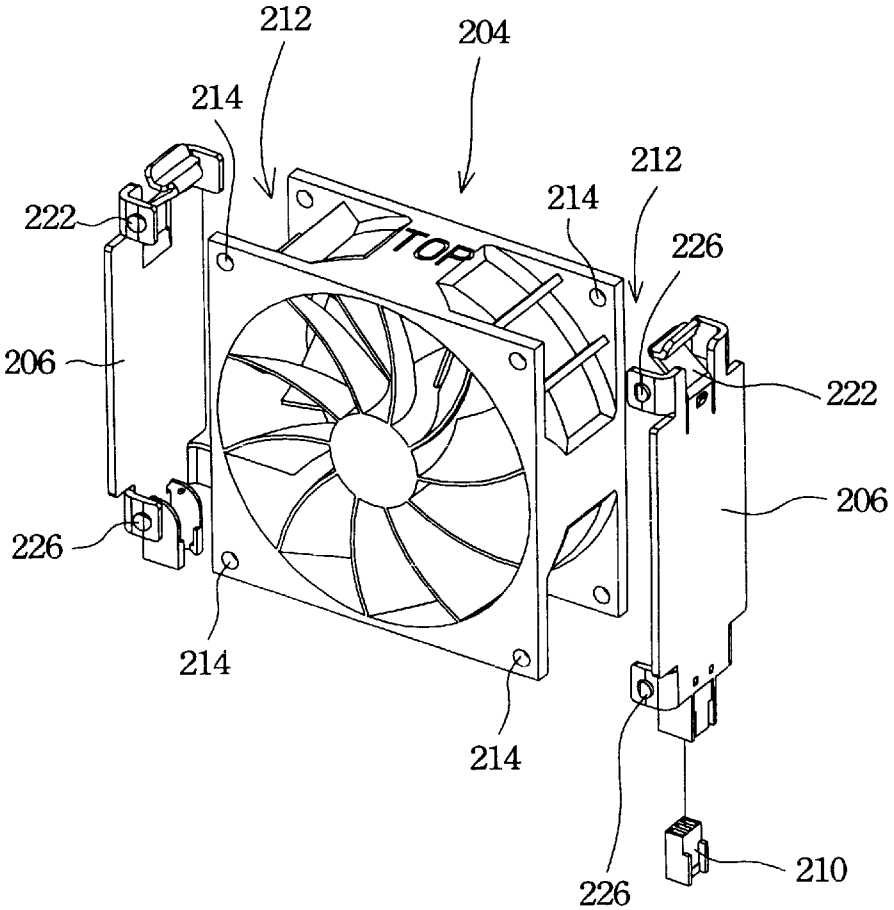
FIG. 1 is a three-dimensional view schematically illustrating a fan before being imbedded with plastic moldings according to a preferred embodiment the present invention.

FIG. 1 is a three-dimensional view schematically illustrating a fan before being imbedded with plastic moldings according to a preferred embodiment the present invention. Referring to FIG. 1, a remedy of the prior art problem is to respectively imbed two substantially identical plastic moldings 206 into two sides 212 of a commercially sold fan 204. The plastic moldings 206 are imbedded through the four holes 214 of the fan 204.

Figure 2:
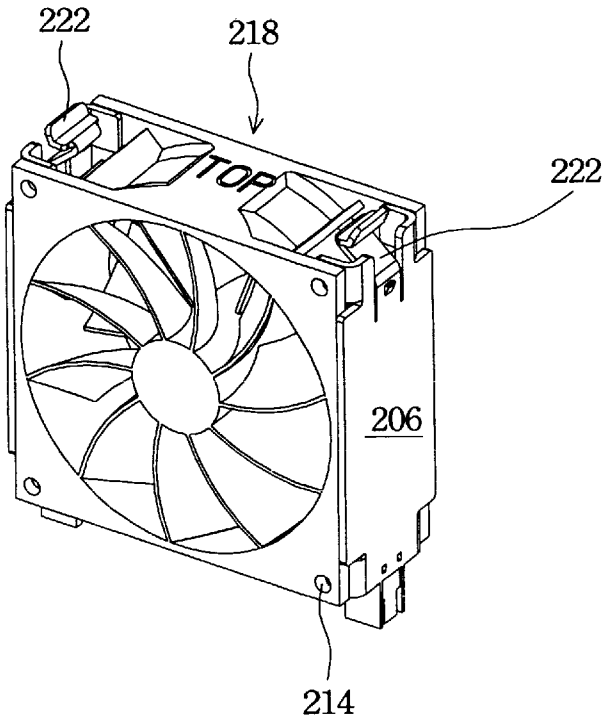
FIG. 2 is a three-dimensional view schematically illustrating a hot swap fan after being imbedded with plastic moldings according to a preferred embodiment the present invention.
Figure 3:
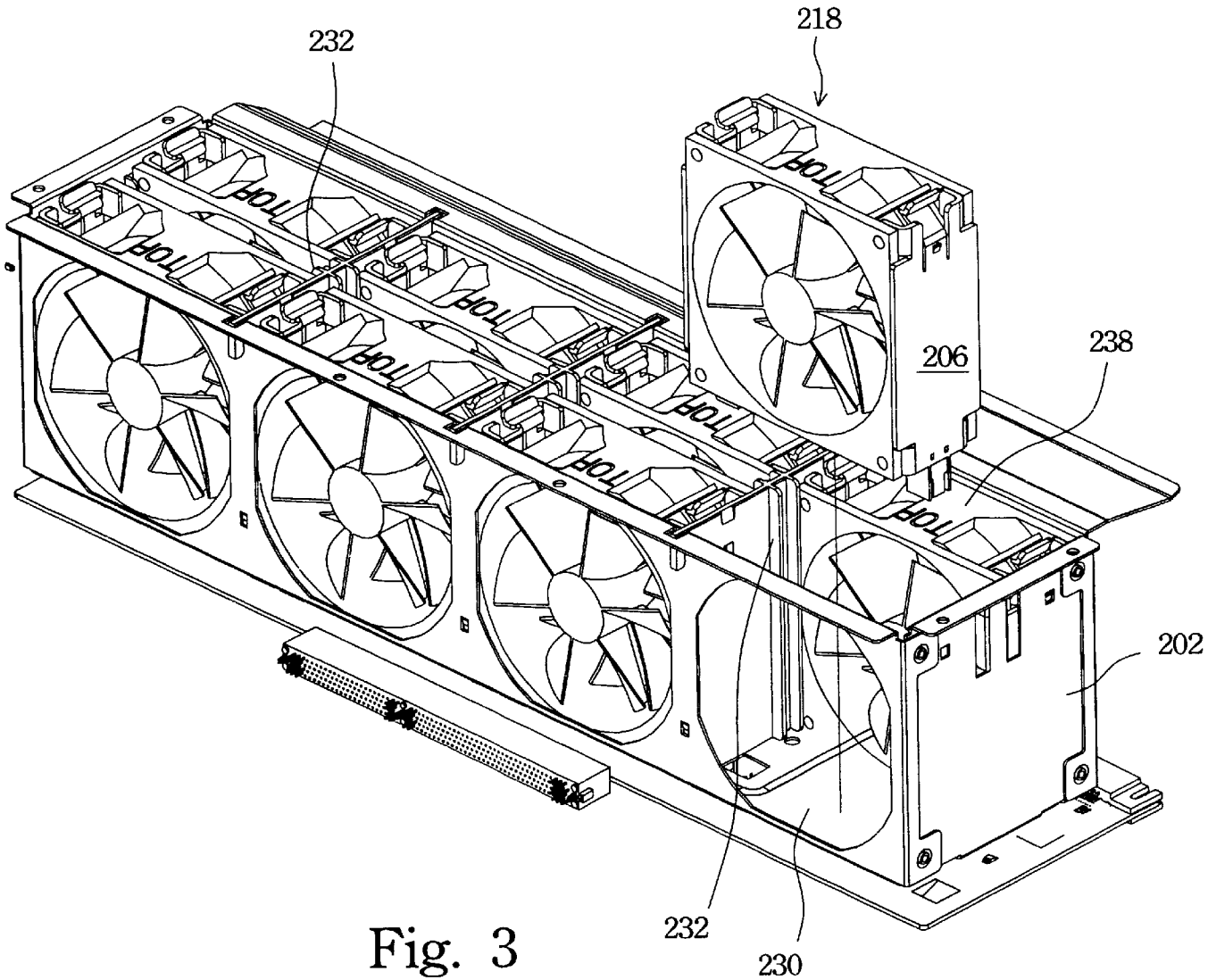
FIG. 3 is a three-dimensional view schematically illustrating eight hot swap fan modules according to a preferred embodiment the present invention.

FIG. 2 is a three-dimensional view schematically illustrating a hot swap fan after being imbedded with plastic moldings according to a preferred embodiment the present invention. Referring to FIG. 2, in a view through the fan axis, the hot swap fan module 218 having the fan 204 (FIG. 1) embedded with plastic moldings 206 is only slightly thicker than the original fan 204 by the two plastic plates (the exposed portions of the plastic moldings 206). Each of the plastic moldings 206 may have a holder 222 for an operator to install the hot swap fan module 218 into the fixed frame 230 or to pull the plastic moldings 206 and the fan 204 (FIG. 1) out of the fixed frame 230 (FIG. 3). In other words, the holders 222 allow the fan to have a hot-swap mode. It is noted that the plastic moldings 206 can be wholly identical. That is, the plastic moldings 206 embedded into the two sides of the fan 204 can be the same. By doing so, design costs can be saved.

Figure 4:
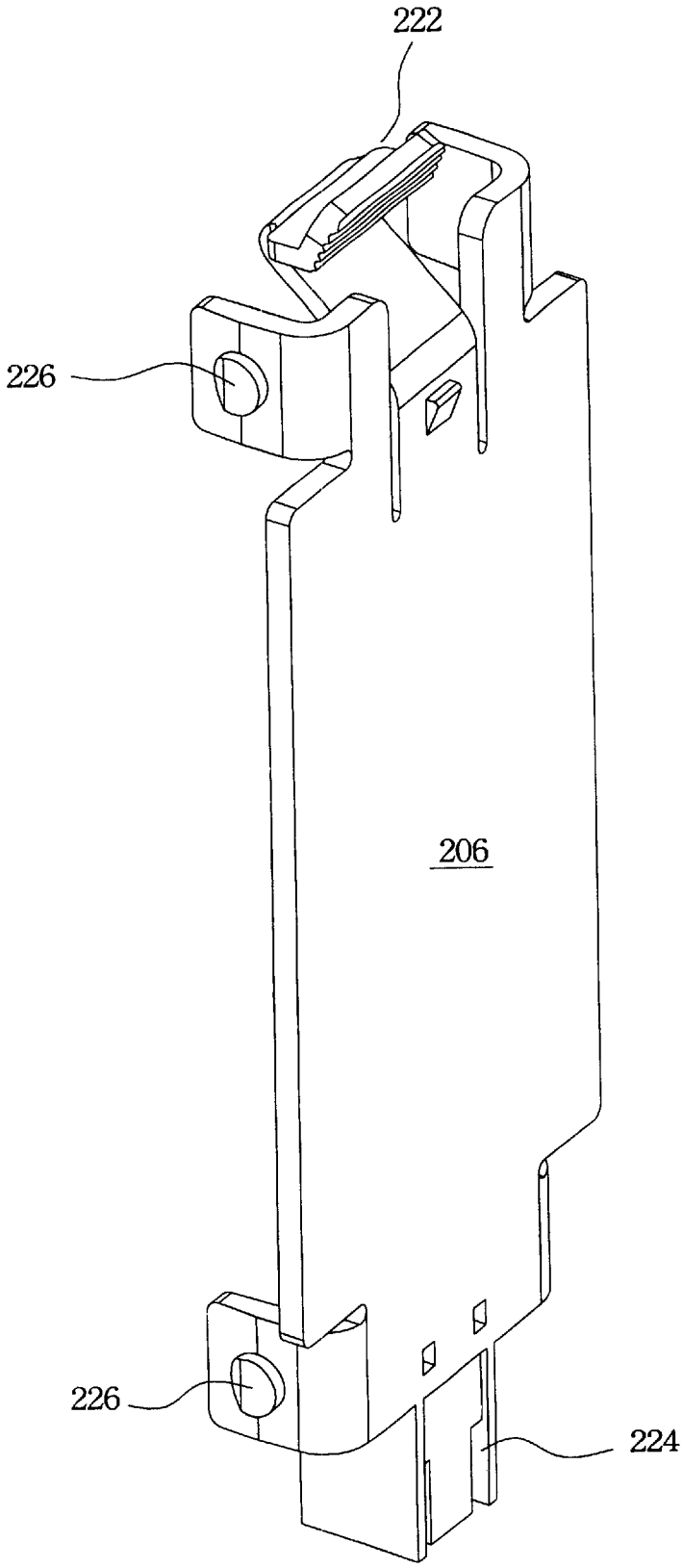
FIG. 4 is a three-dimensional view schematically illustrating plastic moldings according to a preferred embodiment the present invention.

FIG. 4 is a three-dimensional view schematically illustrating plastic moldings according to a preferred embodiment the present invention. Referring to FIG. 4, each of the plastic moldings has four protuberances 226 through the four holes 214 (FIG. 4) for imbedding each of the plastic moldings 206 into each side 212 of the fan 204 (FIG. 1). On the other hand, each of the sides 212 of the fan 204 (FIG. 1) has four holes 214 (FIG. 4) corresponding to the protuberances 226. Through the holes 214, the plastic moldings 206 are respectively imbedded into the two sides 212 of the fan 204. Additionally, each of the plastic moldings 206 has a fastener 224 for fastening the power plug 210 electrically connecting to the fan 204 (FIG. 1).

FIG. 3 is a three-dimensional view schematically illustrating eight hot swap fan modules according to a preferred embodiment the present invention. Referring to FIG. 3, the hot swap fan modules are installed into a fixed frame module 202. The fixed frame module 202 comprises eight fixed frames, wherein each of the frames has at least one guide rail 232 for guiding each the hot swap fan module when the hot swap fan module is installed into or pulled out of the fixed frame. By using the plastic moldings 206 and the fixed frame 230, the hot swap fan module can be installed or removed during server operation. Corresponding to the eight fixed frames, the eight fans are equally arranged into two arrays, wherein one array of the fans is the spare for another array of the fans. According to the arrangement, if a fan such as the fan 218 is pulled out due to failure, the spare fan 238 is activated. After the fan 218 has been repaired and re-installed into the fixed frame 230, the spare fan 238 is deactivated.

Accordingly, the main points of the present invention are as follows:

1. The present invention provides a convenient method of installing the fans into the server or removing the fans from the server.
2. By using the plastic moldings, installing the fans into the fixed frames or pulling the fans out of the fixed frames does not require any tool or screws.

The present invention may have the following advantages:

1. The plastic moldings embedded into the two sides of a fan can be identical, thereby saving design costs.
2. In a view through the fan axis, the fan embedded with plastic moldings is only slightly thicker than the original fan by the two plastic plates (the exposed portions of the plastic moldings. A conventional fan, however, occupies a lot of space because it is fixed in place with many screws and iron fragments.
1. A conventional fan is often fixed in place by using screws and tools. In the contrary, the present invention uses no screws or tools to install or remove the fans.
2. In the present invention, there is no need to change the style of the power plug of the fan to accommodate the hot-swap designation.

As is understood by a person skilled in the art, the foregoing preferred embodiments of the present invention are illustrations of the present invention rather than limitations of the present invention. For example, the protuberances are merely examples of fastening devices. One of ordinary skill in the art may alternatively use other kinds of fastening devices having the same function. Moreover, the number of the fastening devices is not limited to four. On the contrary, the number of the fastening devices can be modified to two or more than two without departing from the spirit of the present invention. Furthermore, the shapes of the holders shown in the drawings are illustrations rather than limitations of the present invention. Various modifications of the holders, for an operator to install the hot swap fan module into or to pull the hot swap fan module out of the fixed frame, are within the scope of the present invention. It is intended to cover various modifications and similar arrangements included within the spirit and scope of the appended claims, the scope of which should be accorded the broadest interpretation so as to encompass all such modifications and similar structure.

What is claimed is:

1. A hot swap fan for a server, the hot swap fan module, comprising:

a fan having two major sides and two minor sides and electrically connecting a power plug for providing cooling air through the two major sides, wherein each major side has four holes; and two plastic moldings having four protuberances respectively, the four protuberances on each of the plastic moldings being fixed into two of the holes on each of the major side to imbed the plastic moldings into the two minor sides.

2. A hot swap fan module for a server, the hotswap fan module comprising:

at least fan being electrically connected with a power plug and having two sides, wherein each side of the fan has four holes; and two identical plastic moldings, wherein each of the plastic moldings has four protuberances through the four holes for imbedding each of the plastic moldings into each side of the fan; and a fastener for fastening the power plug beneath one of the plastic moldings.

3. The hot swap fan module of claim 2, wherein each of the plastic moldings has a holder for an operator to install the hot swap fan module into a fixed frame of the server or to pull the hot swap fan module out of the fixed frame.

4. The hot swap fan module of claim 3, wherein a guide rail for guiding the hot swap fan module when the hot swap fan module is installed into or pulled out of the fixed frame.

5. The hot swap fan module of claim 2, wherein the hot swap fan module has eight fans equally arranged into two arrays, and wherein one array of the fans is a spare for another array of the fans.

6. A plastic molding assembly for a fan of a server, wherein the server has a fixed frame for the fan having two sides, the plastic molding assembly comprising:

a plurality of plastic bodies;

a plurality of protuberances besides each of the plastic bodies, for imbedding the plastic bodies into the two sides of the fan; and a holder on each of the plastic bodies, for an operator to install the plastic molding assembly and the fan into the fixed frame of the server.

7. The plastic molding assembly of claim 6, wherein each of the sides of the fan has a plurality of holes therein corresponding to the protuberances.

8. The plastic molding assembly of claim 7, wherein the plastic bodies are embedded into the two sides of the fan through the holes.

9. The plastic molding assembly of claim 7, wherein each of the sides of the fan has four holes corresponding to the protuberances.

10. The plastic molding assembly of claim 9, wherein the plastic molding assembly has four protuberances.

11. The plastic molding assembly of claim 6, wherein the fixed frame has at least a guide rail for guiding the fan and the plastic molding assembly when the fan and the plastic molding assembly are installed into or pulled out of the fixed frame.

12. A cooling kit for a server, comprising:

at least one fan having two major sides and two minor sides and electrically connecting a power plug for providing cooling through the two major sides, wherein each of the two major sides has a plurality of holes therein;

two plastic moldings having a plurality of fastening devices respectively, the fastening devices on each of the plastic moldings being fixed into at least one of the holes on each of the major side to imbed the plastic moldings into the minor sides; and at least one fixed frame on a server for installing or pulling the fan out.

13. The cooling kit of claim 12, wherein the fixed frame has a guide rail for guiding the fan and the plastic moldings when the fan and the plastic moldings are installed into or pulled out of the fixed frame.

14. The cooling kit of claim 12, wherein the fastening devices are protuberances.

15. A cooling kit for a server, comprising:

at least one fan being electrically connected with a power plug and having two sides, wherein each of the two sides has a plurality of holes therein;

two plastic moldings, wherein each of the plastic moldings has four fastening devices through the four holes for embedding each of the plastic moldings on each side of the fan;

a fastener located on the plastic moldings for fastening the power plug; and at least one fixed frame on the server for installing or pulling out the fan.

16. The cooling kit of claim 15, wherein each of the plastic moldings has a holder thereon for an operator to install the plastic moldings and the fan into the fixed frame.

17. The cooling kit of claim 15, wherein the cooling kit has eight fans equally arranged into two arrays, and wherein one array of the fans is a spare for another array of the fans.

18. The cooling kit of claim 17, wherein the number of the fixed frames is eight.

* * * * *